US007519305B2

(12) United States Patent
Ishikawa

(10) Patent No.: US 7,519,305 B2
(45) Date of Patent: Apr. 14, 2009

(54) FIXING DEVICE AND IMAGE FORMING APPARATUS INCLUDING THE SAME

(75) Inventor: Kazutoshi Ishikawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 315 days.

(21) Appl. No.: 11/578,239

(22) PCT Filed: Apr. 13, 2005

(86) PCT No.: PCT/JP2005/007176

§ 371 (c)(1),
(2), (4) Date: Oct. 12, 2006

(87) PCT Pub. No.: WO2005/101134

PCT Pub. Date: Oct. 27, 2005

(65) Prior Publication Data

US 2007/0223952 A1 Sep. 27, 2007

(30) Foreign Application Priority Data

Apr. 14, 2004 (JP) ..... 2004-119584

(51) Int. Cl.
*G03G 15/20* (2006.01)

(52) U.S. Cl. ..... 399/69

(58) Field of Classification Search ..... 399/67, 399/69, 70, 328

See application file for complete search history.

(56) References Cited

U.S. PATENT DOCUMENTS 5,534,987 A 7/1996 Ohtsuka et al.
5,701,556 A * 12/1997 Sugimoto ..... 399/70
2002/0146253 A1* 10/2002 Kondo et al. ..... 399/67
2003/0053814 A1 3/2003 Suzuki et al.

FOREIGN PATENT DOCUMENTS

| | | | |
|---|---|---|---|
| JP | 59-28177 | A | 2/1984 |
| JP | 3-132784 | | 6/1991 |
| JP | 05-127565 | A | 5/1993 |
| JP | 6-242700 | A | 9/1994 |
| JP | 8-83016 | A | 3/1996 |
| JP | 2003-84623 | A | 3/2003 |

* cited by examiner

*Primary Examiner*—Susan S Lee
(74) *Attorney, Agent, or Firm*—Birch, Stewart, Kolasch & Birch, LLP

(57) ABSTRACT

The present invention realizes a fixing device and an image forming apparatus in each of which (i) the amount of power consumption is small and (ii) a wait time from when a command for starting printing is inputted until when printing is started is short. The fixing device of the present invention includes (i) a fixing roller (250) and a pressure roller (251) which are provided so as to contact each other, (ii) a thermal heater (252) for heating the fixing roller (250), (iii) a thermistor (254) for detecting the temperature of the fixing roller (250), and (iv) a heating control section (255) for controlling a drive start or drive stop of the thermal heater (252). The heating control section (255) carries out control of the thermal heater (252) for a predetermined time, and restarts the control of the thermal heater (252) based on a difference between (i) the temperature of the fixing roller (250) when the control of the thermal heater (252) is stopped and (ii) the temperature of the fixing roller (250) after a certain time has elapsed since the control of the thermal heater (252) is stopped.

8 Claims, 9 Drawing Sheets

FIXING DEVICE AND IMAGE FORMING APPARATUS INCLUDING THE SAME

TECHNICAL FIELD

The present invention relates to a fixing device and an image forming apparatus including this fixing device. More particularly, the present invention relates to (i) a fixing device which is controlled so that a surface temperature of a fixing roller becomes a desired temperature and (ii) an image forming apparatus including this fixing device.

BACKGROUND ART

Conventionally, an image forming apparatus, such as a copier, a printer, and a facsimile, has a fixing device which fixes a toner of an unfixed toner image formed on a transfer material. A conventional fixing device includes, for example, (i) a fixing roller whose surface is heated, (ii) a pressure roller which contacts the fixing roller, and (iii) surface temperature detecting means for detecting a surface temperature of the fixing roller.

In an image forming apparatus including this fixing device, when a main switch is turned ON, a warm-up for warming the fixing device is carried out. However, the temperature of the fixing device is low in the case in which the main switch has been in an OFF state for a long time, such as in the case in which the main switch is turned ON first thing in the morning. On this account, even if the main switch is turned ON for copying, etc. after the main switch has been in the OFF state for a long time, the conventional warm-up may not warm the fixing device sufficiently.

When a printing is carried out even though the fixing device is not warmed sufficiently, heat of the fixing roller of the fixing device is extracted by the transfer material. In this case, the surface temperature of the fixing roller decreases drastically, so that a sufficient fixation performance cannot be obtained. Therefore, the conventional image forming apparatus requires a wait time for warming the fixing device sufficiently. On this account, proposed is a fixing device which does not require a longer warm-up time and can prevent the surface temperature of the fixing roller from decreasing (for example, see Documents 1 and 2).

Document 1 discloses a temperature control device of a heating roller fixing apparatus which includes a fixing roller and a pressure roller each of which has a heater therein, and the temperature control device switches a set temperature of the heater of the pressure roller between at the time of the warm-up and after the warm-up.

In Document 1, the temperature of the pressure roller is set to a high set temperature from the start of the warm-up till the end of it, and the temperature of the pressure roller is switched to a low set temperature after the warm-up. Thus, it is possible to narrow a temperature control range.

Moreover, Document 2 discloses a fixing device in which (i) after the warm-up, a surface temperature of a fixing roller is controlled so as to be temporarily a high set temperature that is higher than a set temperature of the surface temperature of the fixing roller, and (ii) at least one of the temperature level and time length of the high set temperature is variable.

As described above, in Document 2, even after the warm-up, the surface temperature of the fixing roller is controlled so as to be temporarily the high set temperature. On this account, even if copying is consecutively carried out after the warm-up, the surface temperature of the fixing roller just decreases to the set temperature. Moreover, in addition to this, at least one of the temperature level and time length of the high set temperature is changed depending on the surface temperature of the fixing roller at the start of the warm-up. On this account, since the temperature level or the time length of the high set temperature is controlled depending on how much heat the fixing roller is accumulating, it is possible to prevent power from being consumed wastefully.

Document 1

Japanese Unexamined Patent Publication No. 28177/1984 (Tokukaisho 59-28177 (published on Feb. 14, 1984))

Document 2

Japanese Unexamined Patent Publication No. 127565/1993 (Tokukaihei 5-127565 (published on May 25, 1993))

In Document 1, since the temperature of the pressure roller is the high set temperature from the start of the warm-up till the end of it, the increase in the warm-up time is prevented. However, since the temperature of the pressure roller is switched to the low set temperature after the warm-up, the surface of the fixing roller is not heated sufficiently.

That is, Document 1 is just to narrow the temperature control range from the surface temperature of the fixing roller after the warm-up and the surface temperature of the fixing roller after the fixing roller is sufficiently rotated and waits ready. On this account, the warm-up terminates when the surface temperature of the fixing roller has reached the set temperature. If the printing is started in this state, the surface temperature of the fixing roller decreases, so that the sufficient fixation performance cannot be obtained.

Further, in Document 1, the fixing roller is kept heated so that the surface temperature of the fixing roller is maintained to the set temperature even after the warm-up. Therefore, a problem in Document 1 is that the amount of power consumption is large.

In Document 2, even after carrying out copying consecutively, the surface temperature of the fixing roller just decreases to the set temperature. This is realized by heating the fixing roller after the warm-up so that the surface temperature of the fixing roller is temporarily the high set temperature. In this case, it is necessary to keep heating the fixing roller at high temperature not only at the time of the warm-up but also after the warm-up. Therefore, as with Document 1, a problem in Document 2 is that the amount of power consumption is large.

In Document 2, in order to prevent power from being consumed wastefully, at least one of the temperature level and time length of the high set temperature is changed depending on how much heat the fixing roller is accumulating. However, since the fixing roller is kept heated at high temperature after the warm-up also in this case, the amount of power consumption is large.

Here, in order to reduce the amount of power consumption, it may be possible to think of a driving method (hereinafter referred to as "energy saving mode") for not heating the fixing roller except at the time of the warm-up and at the time of the printing. However, in the energy saving mode, even if the printing is requested immediately after the main switch of the image forming apparatus is turned ON, the surface temperature of the fixing roller is not high enough. Therefore, a problem here is that the wait time from when a command for starting printing is inputted until when the printing is started becomes long.

That is, when the main switch of the image forming apparatus is turned ON, cleaning of a photoreceptor is carried out in addition to the heating of the fixing roller, as the warm-up. In the case of the energy saving mode, the warm-up is carried out while the cleaning of the photoreceptor is being carried out, and the warm-up terminates when the cleaning of the photoreceptor terminates.

In this case, if the fixing roller is heated only while the cleaning of the photoreceptor is being carried out, the surface temperature of the fixing roller does not become high enough. That is, as shown in FIG. 9, the heating of the fixing roller terminates at a time point t13 at which the warm-up terminates. In this case, the heating of the fixing roller terminates before the surface temperature of the fixing roller reaches a printable temperature. Moreover, since the heating of the fixing roller terminates, the surface temperature of the fixing roller further decreases as time advances. Therefore, in order to carry out fixing securely, it is necessary to start the heating of the fixing roller at a time point t14 at which the command for starting the printing is inputted. In addition, this heating of the fixing roller needs to be carried out until the temperature of the fixing roller reaches the printable temperature. As a result, the wait time from when a command for starting printing is inputted until when the printing is started becomes long.

The present invention was made to solve the above-described problems, and an object of the present invention is to realize a fixing device and an image forming apparatus each of which is such that, even if the printing is started when the surface temperature of the fixing device is completely low, the amount of power consumption is small and the wait time from when a command for starting printing is inputted until when the printing is started is short.

DISCLOSURE OF INVENTION

In order to solve the above-described problems, the fixing device of the present invention includes: a first roller and a second roller which are provided so as to contact each other; heating means for heating the first roller; temperature detecting means for detecting a temperature of the first roller; and heating control means for controlling a drive start or drive stop of the heating means based on the temperature detected by the temperature detecting means, the fixing device fixing a developer image formed on a recording material conveyed to between the first roller and the second roller, the heating control means carrying out control of the heating means for a predetermined time, and restarting the control of the heating means based on a difference between the temperature of the first roller when the control of the heating means is stopped and the temperature of the first roller after a certain time has elapsed since the control of the heating means is stopped.

According to the above-described configuration, the fixing device is provided so that the first roller and the second roller contact each other, and fixes the developer image on the recording material by conveying the recording material to between these rollers.

Moreover, the heating means heats the first roller. Thus, the temperature of the first roller, especially the surface temperature of the first roller, rises. In this case, fixing of a developer onto the recording material is carried out by heating and melting the developer. Thus, it is possible to carry out the fixing more efficiently.

Here, when the temperature of the first roller is too high or too low, it is difficult to carry out the fixing of the developer onto the recording material efficiently. Especially, immediately after the startup of the fixing device, or after the fixing device has not operated for a long time, the temperature of the first roller is low. On this account, it is necessary to heat the first roller to carry out the fixing appropriately. Meanwhile, when the temperature of the first roller is too high, the recording material is curled, which is not preferable.

The temperature of the first roller is detected by the temperature detecting means. By detecting the temperature of the first roller by the temperature detecting means, it is possible to periodically monitor whether or not the temperature of the first roller is an appropriate temperature.

Moreover, the heating control means controls the heating means based on the temperature detected by the temperature detecting means. The heating control means repeatedly carries out the drive start or drive stop of the heating means so that the temperature of the first roller becomes an appropriate temperature. The heating control means carries out the control of the heating means for a predetermined time. That is, the control of the heating means stops when the predetermined time has elapsed.

Note that the temperature detecting means detects (i) the temperature of the first roller when the control of the heating means is stopped and (ii) the temperature of the first roller after a certain time has elapsed since the control of the heating means is stopped. The heating control means restarts the control of the heating means based on a difference between these temperatures. That is, when the difference is larger than a predetermined value, the heating control means restarts the control of the heating means, and when the difference is smaller than the predetermined value, the heating control means does not restart the control of the heating means. Thus, when the temperature of the first roller has decreased drastically after the control of the heating means is stopped, the control of the heating means is restarted, so that the first roller can be heated.

As a result, it is possible to shorten a time for heating the first roller to appropriately carry out the fixing. Moreover, since the control of the heating means is restarted only when the temperature of the first roller has decreased drastically, it is not necessary to always drive the heating means, so that it is possible to reduce the amount of power consumption.

In order to solve the above-described problems, an image forming apparatus of the present invention includes any one of the above-described fixing devices. According to the above-described configuration, the fixing device restarts the control of the heating means when the temperature of the first roller has decreased drastically. On this account, in addition to the heating of the first roller, it is possible to heat an inside of the image forming apparatus. In this case, it is possible to slow down the speed of decrease in the temperature of the first roller when the control of the heating means is stopped. As a result, it is possible to shorten a time from when a command for starting printing is inputted until when the printing is actually started.

BEST MODE FOR CARRYING OUT THE INVENTION

EMBODIMENT 1

Figure 1:
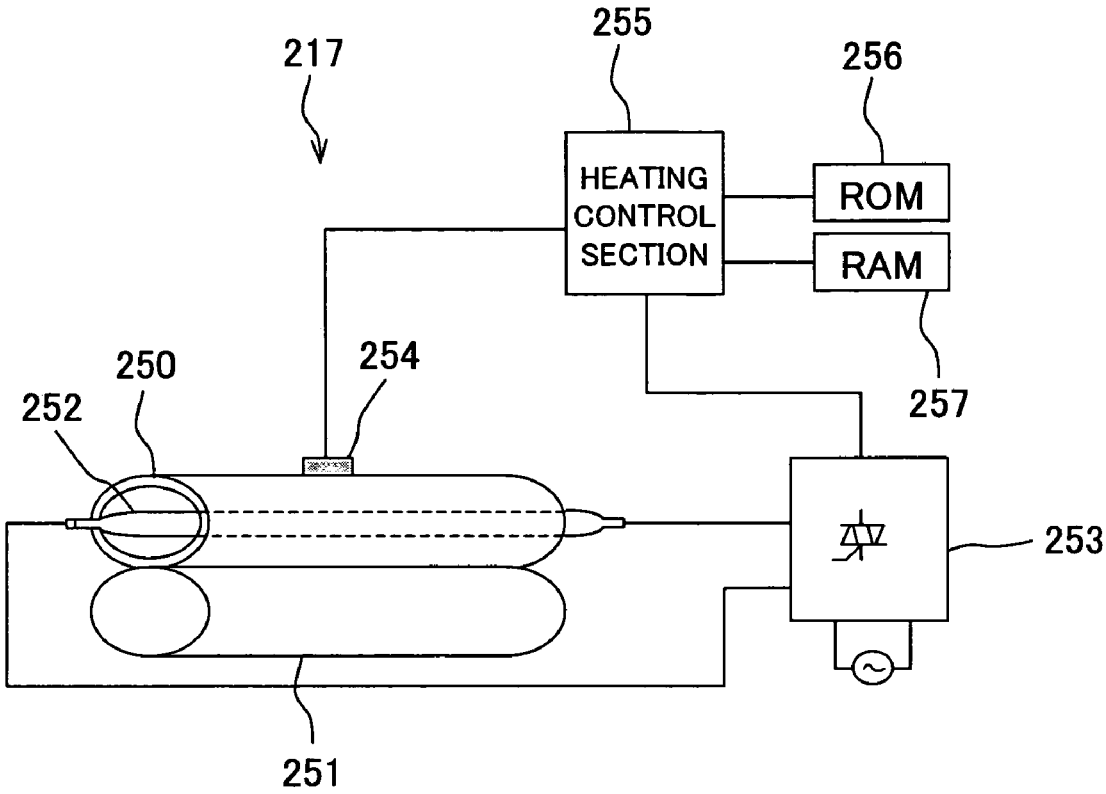
FIG. 1 shows one embodiment of the present invention, and is a schematic diagram showing a schematic configuration of a fixing device.
Figure 2:
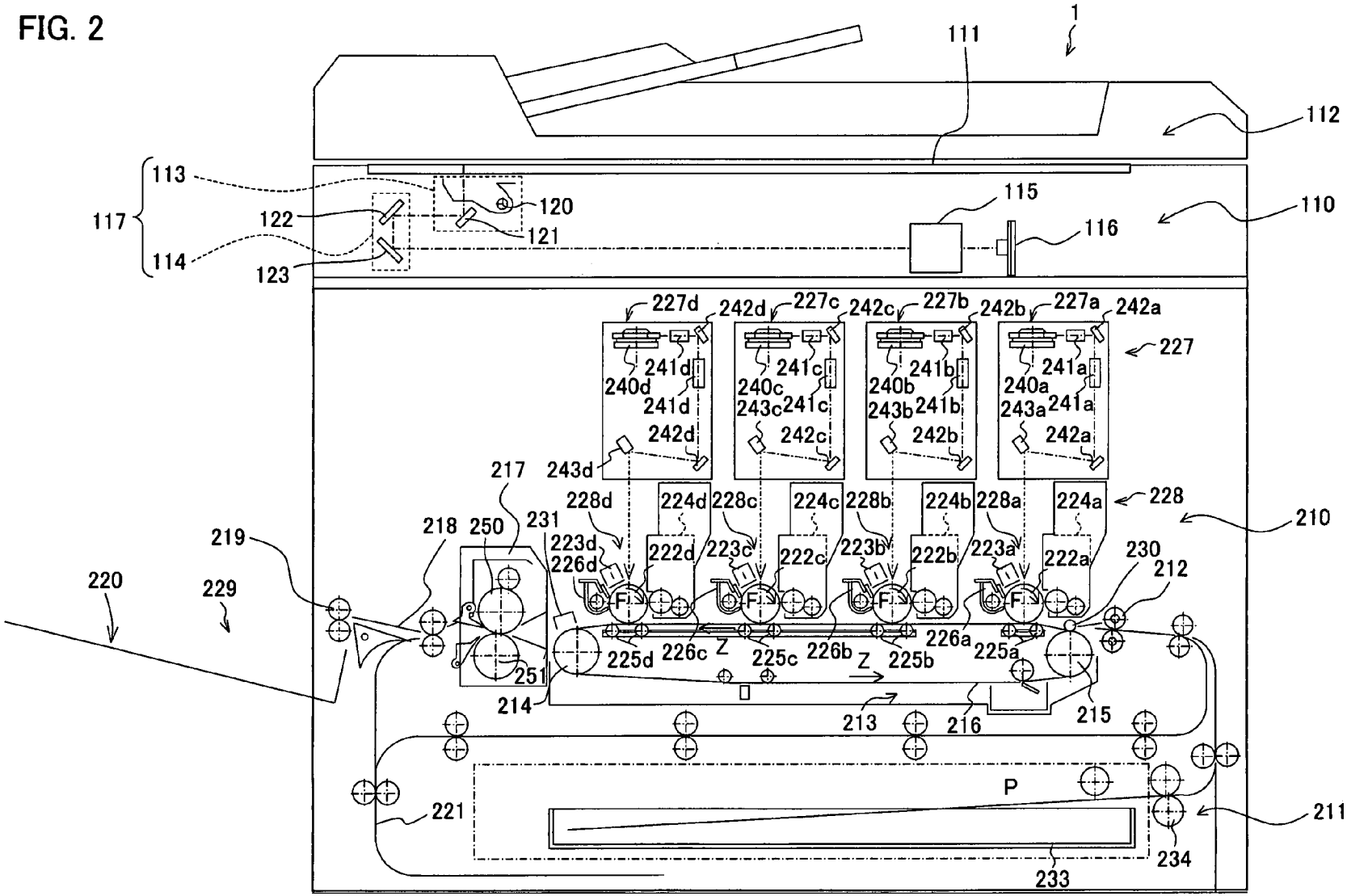
FIG. 2 shows the embodiment of the present invention, and is a cross-sectional diagram showing a schematic configuration of a digital color copier.

The following will explain Embodiment 1 of the present invention in reference to FIGS. 1 to 5. The present embodiment will explain, as an example, a digital color copier 1 that is an image forming apparatus. FIG. 2 is a cross-sectional diagram showing a schematic configuration of the digital color copier 1 of the present embodiment.

As shown in FIG. 2, the digital color copier 1 includes a document table 111, a reversing automatic document feeder 112, an image reading section 110, an image forming section 210, a paper feeding section 211, and a paper output section 229.

The document table 111 is a table for placing a document for image formation, and is provided on an upper surface of a main body of the digital color copier 1. The reversing automatic document feeder (RADF) 112 conveys a document to a predetermined position of the document table 111. The reversing automatic document feeder 112 is attached to an upper surface of the document table 111, and is supported by the document table 111 so as to be located at a predetermined position with respect to the upper surface of the document table 111 and so as to be able to open and close with respect to the document table 111.

The reversing automatic document feeder 112 conveys a document so that one surface of the document faces the image reading section 110 at a predetermined position of the document table 111. After reading an image on the above-described one surface of the document, the reversing automatic document feeder 112 conveys the document so that another surface of the document faces the image reading section 110 at a predetermined position of the document table 111. That is, the reversing automatic document feeder 112 conveys a document so that an image on one surface or images on both surfaces of the document is (are) read. After reading the image(s) on the surface(s) of a single document, the reversing automatic document feeder 112 outputs this document, and executes a reading and conveying operation for a following document. Operations of conveying and inverting the document are controlled in association with operations of the entire digital color copier 1.

The image reading section 110 reads an image on a document placed on the document table 111, and is provided under the document table 111. The document here may be a document conveyed to the document table 111 by the reversing automatic document feeder 112 or may be a document directly placed on the document table 111. The image reading section 110 includes a document scanning body 117, an optical lens 115, and a CCD line sensor 116.

The document scanning body 117 is constituted by a first scanning unit 113 and a second scanning unit 114. The first scanning unit 113 includes (i) an exposure lamp for exposing an image surface of a document and (ii) a first mirror which deflects an optical image, reflected from the document, toward a predetermined direction. The first scanning unit 113 reciprocates parallel at a predetermined scanning speed while maintaining a certain distance with respect to a lower surface of the document table 111. The second scanning unit 114 includes a second mirror and a third mirror which deflect the optical image, deflected by the first mirror of the first scanning unit 113, toward a predetermined direction (direction in which the optical lens 115 is provided). The second scanning unit 114 reciprocates parallel while maintaining a certain speed relationship with the first scanning unit 113.

The optical lens 115 reduces the size of the optical image deflected by the third mirror of the second scanning unit 114, and forms the reduced optical image on a light receiving surface of the CCD line sensor 116.

The CCD line sensor 116 is an optical transducer. The CCD line sensor 116 sequentially transduces the optical image formed by the optical lens 115, and outputs it as an electric signal. It is preferable that the CCD line sensor 116 be a so-called three-line color CCD which can read a black-and-white image or a color image, and output line data obtained by carrying out color separation for respective color components of R (Red), G (Green), and B (Blue). Further, document image information which has been converted to the electric signal by the CCD line sensor 116 is transferred to an image processing section (not shown), and is subjected to a predetermined image data processing.

The paper feeding section 211 includes a sheet tray 233, a paper feeding roller 234, a resist roller 212, etc. The paper feeding section 211 supplies sheets (recording mediums) P, stored in the sheet tray 233, to the image forming section 210 one-by-one. The sheets P supplied one-by-one are conveyed to the image forming section 210 while controlling a timing by a pair of the resist rollers 212 provided between the sheet tray 233 and the image forming section 210. In the case of a so-called two-side image forming mode in which images are formed on both sides of the sheet P, the sheet P, on one side of which an image is formed, is again conveyed to the image forming section 210 at such a timing that the image forming section 210 can form an image on another side of the sheet P.

In the digital color copier 1 of the present embodiment, cut sheets of paper are used as the sheets P. The sheet P is supplied from the sheet tray 233 to a guide, along a sheet conveyance path, of the paper feeding section 211, and a sensor (not shown) detects a tip portion of the sheet P. Then, the sheet P is once stopped by a pair of the resist rollers 212 on the basis of a detection signal output from this sensor, and is conveyed to the image forming section 210 at a timing for image formation.

After the image reading section 110 reads the image information, the image forming section 210 forms an image on the sheet P on the basis of the document image information subjected to the image data processing by the image processing section. The image forming section 210 includes a transferring/conveying belt mechanism 213, a fixing section (fixing device) 217, an image forming station 228, and a laser beam scanner unit 227.

The transferring/conveying belt mechanism 213 includes (i) a driving roller 214, (ii) a driven roller 215, and (iii) a transferring/conveying belt (transfer carrier) 216 which stretches substantially parallel between the driving roller 214 and the driven roller 215. The transferring/conveying belt 216 is friction-driven, in a direction indicated by an arrow Z shown in FIG. 2, by the rotation of the driving roller 214. The sheet P supplied through the paper feeding section 211 is supplied to the transferring/conveying belt 216 at a timing for image formation, and is conveyed to the image forming station 228 while being held by the transferring/conveying belt 216 by electrostatic attraction.

The image forming station 228 duplicates on the sheet P a toner image corresponding to the image information of the document. The image forming station 228 is constituted by a first image forming station 228*a* corresponding to a black component, a second image forming station 228*b* corresponding to a cyan component, a third image forming station 228*c* corresponding to a magenta component, and a fourth image forming station 228*d* corresponding to a yellow component. These image forming stations 228*a*, 228*b*, 228*c*, and 228*d* are provided above and close to the transferring/conveying belt 216, and are provided parallel and in this order from upstream of the sheet conveyance path.

The image forming stations 228*a* to 228*d* have substantially the same configuration. The image forming stations 228*a* to 228*d* respectively have photosensitive drums 222*a*, 222*b*, 222*c*, and 222*d*, each of which rotates in a direction indicated by an arrow F shown in FIG. 2. At the periphery of the photosensitive drum (222*a*, 222*b*, 222*c*, 222*d*), a charger (223*a*, 223*b*, 223*c*, 223*d*) for uniformly charging the photosensitive drum, a development device (224*a*, 224*b*, 224*c*, 224*d*) for developing an electrostatic latent image formed on the photosensitive drum, a transfer roller (225*a*, 225*b*, 225*c*, 225*d*) which functions as a transfer electrode for transferring a developed toner image, formed on the photosensitive drum, to the sheet P, and a cleaning device (226*a*, 226*b*, 226*c*, 226*d*) for removing the toner remaining on the photosensitive drum are sequentially provided along a rotation direction of the photosensitive drum.

The laser beam scanner unit 227 writes the electrostatic latent image to the photosensitive drum 222 on the basis of the image information. The laser beam scanner unit 227 is constituted by a first laser beam scanner unit 227*a* corresponding to the black component, a second laser beam scanner unit 227*b* corresponding to the cyan component, a third laser beam scanner unit 227*c* corresponding to the magenta component, and a fourth laser beam scanner unit 227*d* corresponding to the yellow component.

The laser beam scanner units 227*a* to 227*d* are provided above the photosensitive drums 222*a* to 222*d*, respectively, and have substantially the same configuration. The laser beam scanner unit (227*a*, 227*b*, 227*c*, 227*d*) is constituted by (i) a semiconductor laser element (not shown) which emits dot light modulated in accordance with image data, (ii) a polygon mirror (deflecting device) (240*a*, 240*b*, 240*c*, 240*d*) for deflecting a laser beam, from the semiconductor laser element, toward a main scanning direction, (iii) an fθ lens (241*a*, 241*b*, 241*c*, 241*d*) for focusing the laser beam, deflected by the polygon mirror (240*a*, 240*b*, 240*c*, 240*d*), on the surface of the photosensitive drum (222*a*, 222*b*, 222*c*, 222*d*), (iv) a mirror (242*a*, 242*b*, 242*c*, 242*d*), (v) a mirror (243*a*, 243*b*, 243*c*, 243*d*), etc.

A pixel signal corresponding to a black component image of a color document image is inputted to the laser beam scanner unit 227*a*, a pixel signal corresponding to a cyan component image of the color document image is inputted to the laser beam scanner unit 227*b*, a pixel signal corresponding to a magenta component image of the color document image is inputted to the laser beam scanner unit 227*c*, and a pixel signal corresponding to a yellow component image of the color document image is inputted to the laser beam scanner unit 227*d*.

The laser beam scanner unit (227*a*, 227*b*, 227*c*, 227*d*) emits a laser beam corresponding to the input pixel signal, and focuses the laser beam on the surface of the photosensitive drum (222*a*, 222*b*, 222*c*, 222*d*). Then, the laser beam scanner unit (227*a*, 227*b*, 227*c*, 227*d*) scans the laser beam so as to expose the photosensitive drum (222*a*, 222*b*, 222*c*, 222*d*). Thus, optical writing is carried out with respect to the photosensitive drum (222*a*, 222*b*, 222*c*, 222*d*).

Thus, the electrostatic latent image corresponding to color-converted document image information is formed on each of the photosensitive drums 222*a* to 222*d*. Then, the development device 224*a* stores a black toner, the development device 224*b* stores a cyan toner, the development device 224*c* stores a magenta toner, and the development device 224*d* stores a yellow toner. The electrostatic latent images on the photosensitive drums 222*a* to 222*d* are developed by these color toners. Thus, the document image information color-converted by the image forming section 210 is duplicated as respective color toner images.

A sheet attracting charger 230 is provided between the resist roller 212 and the first image forming station 228*a*. The sheet attracting charger 230 charges the surface of the transferring/conveying belt 216. The sheet P supplied from the paper feeding section 211 is surely attracted by the electrostatic attraction on the transferring/conveying belt 216 whose surface is charged, and is conveyed from the first image forming station 228*a* to the fourth image forming station 228*d* without the occurrence of shifting of the sheet P.

Then, in the image forming stations 228*a* to 228*d*, the toner images developed on the photosensitive drums 222*a* to 222*d* are transferred to the sheet P. That is, in the image forming stations 228*a* to 228*d*, respective color toner images are formed. Then, these toner images overlaps each other on the sheet P which is conveyed by the transferring/conveying belt 216 using the electrostatic attraction.

Moreover, a discharger 231 is provided between the fourth image forming station 228*d* and the fixing section 217. An alternating current for separating the sheet P, attracted on the transferring/conveying belt 216 by the electrostatic attraction, from the transferring/conveying belt 216 is applied to the discharger 231. That is, the sheet P onto which the images are transferred by the image forming stations 228*a* to 228*d* is separated from the transferring/conveying belt 216 from the tip portion of the sheet P. Then, the sheet P is conveyed to the fixing section 217.

The fixing section 217 fixes on the sheet P the toner image transferred to and formed on the sheet P. The fixing section 217 is provided downstream of the transferring/conveying belt mechanism 213 in the sheet conveyance path, and includes a fixing roller (first roller) 250 and a pressure roller (second roller) 251. The sheet P passes through a nip portion between the fixing roller 250 and the pressure roller 251, so that the toner image is fixed on the sheet P. Then, after the sheet P is separated from the fixing roller, it is conveyed to the paper output section 229. A detailed configuration of the fixing section 217 will be described later.

The paper output section 229 outputs the sheet P, which has completed the image formation, to outside the digital color copier 1. The paper output section 229 includes a conveyance direction switching gate 218, an output roller 219, and a paper output tray 220. The sheet P conveyed from the fixing section 217 passes through the conveyance direction switching gate 218, is conveyed by the output roller 219, and is output from a paper output opening (not shown) to the paper output tray 220 attached to an external wall of the main body of the digital color copier 1.

The conveyance direction switching gate 218 switches a conveyance path of the sheet P on which the toner image has been fixed, that is, the conveyance direction switching gate 218 selectively switches between (i) a path for outputting the sheet P to the paper output tray 220 and (ii) a path for resupplying the sheet P toward the image forming section 210. In the two-side image forming mode, after an image is formed on one surface of the sheet P, the conveyance direction switching gate 218 switches a conveyance direction so that the sheet P is conveyed toward the image forming section 210 again. After the sheet P is inverted through a switch back conveyance path 221, the sheet P is supplied to the image forming section 210 again. In a one-side image forming mode, after an image is formed on one surface of the sheet P, the sheet P passes through the conveyance direction switching gate 218, and is outputted by the output roller 219 to the paper output tray 220 attached to the external wall of the main body of the digital color copier 1.

According to the foregoing explanation, the laser beam scanner unit (227*a*, 227*b*, 227*c*, 227*d*) scans the laser beam so as to expose the photosensitive drum (222*a*, 222*b*, 222*c*, 222*d*), so that the optical writing is carried out with respect to the photosensitive drum (222*a* to 222*d*). However, in the present invention, instead of the laser beam scanner unit (227*a*, 227*b*, 227*c*, 227*d*), it is possible to use, as means for carrying out the optical writing with respect to the photosensitive drum (222*a*, 222*b*, 222*c*, 222*d*), a fixed scanning/writing optical system (LED head) constituted by a light emitting diode array, an imaging lens array, etc. The LED head is smaller in size than the laser beam scanner unit. Moreover, the LED head does not have any movable part, so that it is silent. On this account, the LED head is preferably used in the image forming apparatus, such as a tandem-type digital color copier which needs a plurality of optical writing units.

The digital color copier 1 includes a control section which controls a series of operations. Operations related to the above-described image reading, image processing, and image formation are controlled by the control section. Moreover, the temperature of the fixing section 217 (will be described later) is controlled by a heating control section. Details of the heating control section will be described later.

Next, the following will explain the fixing section 217 of the present embodiment. FIG. 1 is a schematic diagram showing a schematic configuration of the fixing section 217. As shown in FIG. 1, the fixing section 217 includes the fixing roller 250, the pressure roller 251, a thermal heater (heating means) 252, a heater driving circuit 253, a thermistor (temperature detecting means) 254, a heating control section (heating control means) 255, a ROM 256, and a RAM 257.

The fixing roller 250 and the pressure roller 251 are placed so as to contact each other. By causing the sheet P to pass through a contacting portion (nip portion) where the fixing roller 250 and the pressure roller 251 contact each other, the toner image transferred onto the sheet P is fixed. Each of the fixing roller 250 and the pressure roller 251 is configured by, for example, forming a silicone rubber layer on an aluminum core bar. Moreover, the thermal heater 252 is provided inside the core bar of the fixing roller.

The thermal heater 252 heats the fixing roller 250. The thermal heater 252 is connected with the heater driving circuit 253 that is power supplying means, and is turned ON or OFF depending on whether or not power is supplied from the heater driving circuit 253. For example, a halogen lamp can be used as the thermal heater 252.

The heater driving circuit 253 is connected with the heating control section 255. The heater driving circuit 253 is powered by a commercial power source, drives by inputting a trigger signal, for turning ON or OFF a heater, output from the heating control section 255, and supplies power to the thermal heater 252 on the basis of the trigger signal.

The thermistor 254 is provided so as to contact the surface of the fixing roller 250, and detects the surface temperature of the fixing roller 250. Moreover, the thermistor 254 is connected with an A/D converter (not shown) provided in the heating control section 255. The thermistor 254 outputs the detection result as a temperature detection signal to the heating control section 255.

As described above, the heating control section 255 controls the temperature of the fixing section 217. The temperature control of the fixing section 217 is carried out by controlling the surface temperature of the fixing roller 250. For example, a CPU (Central Processing Unit) can be used as the heating control section 255.

The heating control section 255 outputs the trigger signal to the heater driving circuit 253. Moreover, the heating control section 255 causes the A/D converter to convert the temperature detection signal, output from the thermistor 254, to a digital signal, and outputs it to the ROM 256. Further, the heating control section 255 includes time counting means (not shown) for counting a driving time of the thermal heater 252. The time counting means may not be included in the heating control section 255, that is, may be provided separately.

The heating control section 255 is connected with the ROM 256 and the RAM 257. The ROM 256 stores, for example, a program for controlling a timing of starting and/or terminating the warm-up. For example, the ROM 256 stores (i) a program for carrying out the temperature control of the surface of the fixing roller 250 on the basis of the inputted driving time of the thermal heater 252 and (ii) a program for carrying out the temperature control of the surface of the fixing roller 250 on the basis of the temperature detection signal, output from the thermistor 254, inputted through the heating control section 255.

The RAM 257 stores various control data used when the heating control section 255 controls the temperature of the fixing section 217. For example, the RAM 257 stores control data for controlling the surface temperature of the fixing roller 250, such as (i) a set temperature that the surface temperature of the fixing roller 250 reaches after the warm-up and (ii) a set temperature for driving the thermal heater 252 again after the surface temperature of the fixing roller 250 has decreased.

The heating control section 255 carries out the temperature control of the fixing section 217 on the basis of the control data and program(s) stored in the ROM 256 or the RAM 257. That is, the heating control section 255 controls the surface temperature of the fixing roller 250 on the basis of the program(s) stored in the ROM 256, and this control is carried out by reading, according to need, the control data stored in the RAM 257.

Specifically, the thermistor 254 detects the surface temperature of the fixing roller 250, and then the heating control section 255 controls ON or OFF (drive start or drive stop) of the thermal heater 252 on the basis of this detection result. Moreover, the heating control section 255 controls the heating means for a predetermined time.

The heating control section 255 may be provided separately from the control section which controls a series of operations of the digital color copier 1, but may be provided in the control section. Moreover, the ROM 256 may store a program(s) for carrying out a printing operation, a waiting processing, etc. of the digital color copier 1, and the RAM 257 may store various control data or programs used when the digital color copier 1 controls a series of operations.

In this case, the control section controls a series of operations of the digital color copier 1, including operations of the fixing section 217, on the basis of the control data and programs stored in the ROM 256 or the RAM 257. That is, the control section carries out various controls, such as a printing operation, the warm-up, and the control of the surface temperature of the fixing roller 250, on the basis of the program(s)

stored in the ROM 256. These controls are carried out by reading, according to need, the control data stored in the RAM 257.

Next, the following will explain a series of operations of the digital color copier 1.

When the digital color copier 1 is started up by turning ON the main switch, it carries out, for example, cleaning of the photosensitive drums 222*a* to 222*d* and heating (warn-up) of the fixing roller 250, in order to carry out the image formation accurately. The present embodiment will explain the digital color copier 1 which drives in the energy saving mode in which the fixing roller 250 is not heated except at the time of the warm-up and at the time of the printing.

Since the photosensitive drums 222*a* to 222*d* and the toner of the digital color copier 1 are consumables, they need to be replaced sometimes. This replacement is carried out by opening and closing a replacement cover of the digital color copier 1. When replacing these, the photosensitive drums 222*a* to 222*d* may not be cleaned. Therefore, the cleaning of the photosensitive drums 222*a* to 222*d* and the warm-up is carried out when opening and closing the cover, in addition to at the startup of the digital color copier 1. The present embodiment will explain the warm-up at the startup of the digital color copier 1 in reference to FIG. 3.

Figure 3:
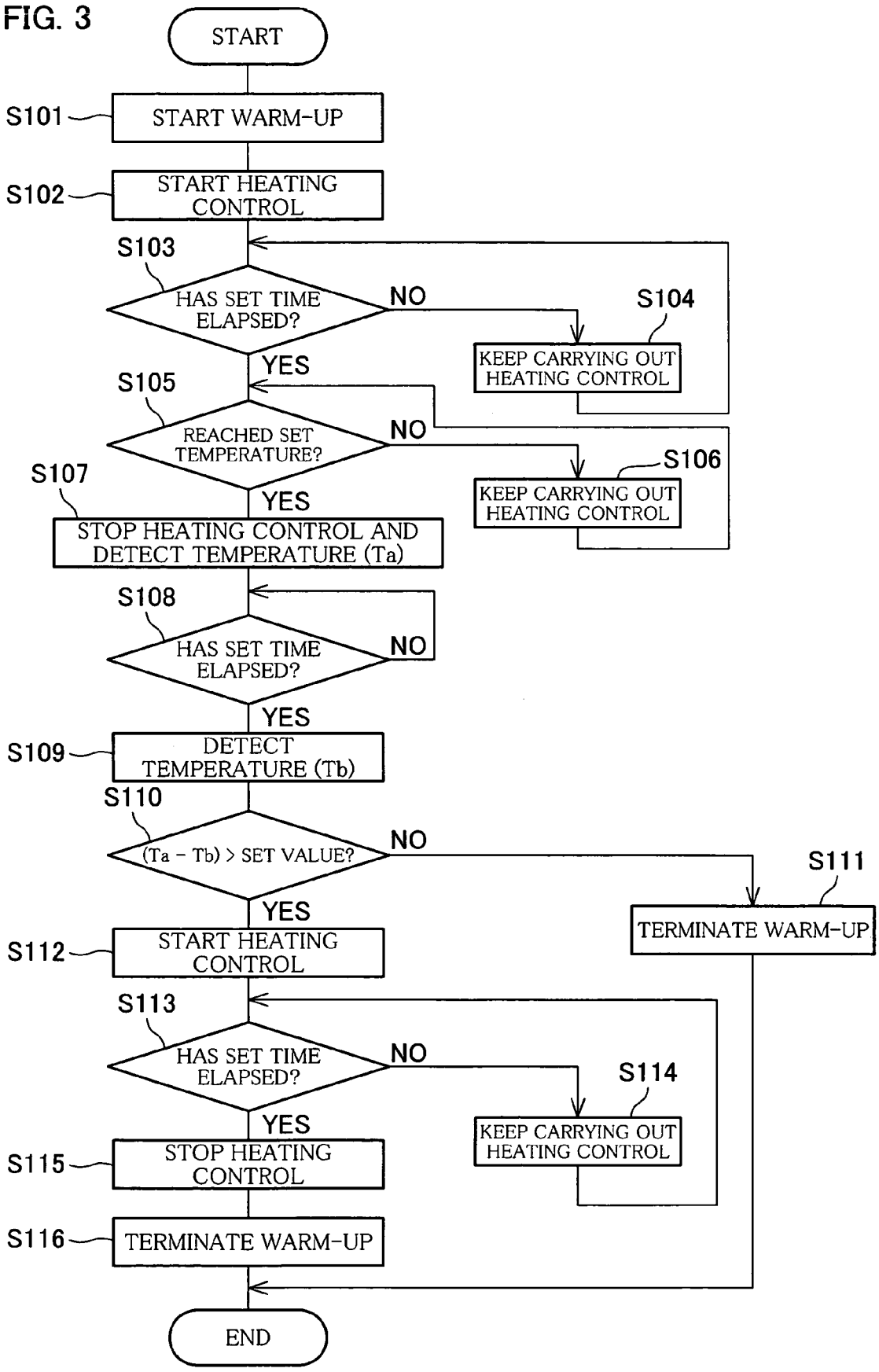
FIG. 3 shows the embodiment of the present invention, and is a flow chart showing heating control (temperature control) of the fixing device.

As shown in FIG. 3, when the main switch of the digital color copier 1 is turned ON, the heating control section 255 (or the control section (the heating control section 255 may be replaced with the control section in the following description)) instructs to start the warm-up (S101). That is, the heating control section 255 starts the heating control (S102). Thus, the heater driving circuit 253 is turned ON, and the thermal heater 252 starts heating the fixing roller 250. The surface temperature of the fixing roller 250 rises by heating of the thermal heater 252.

Moreover, the thermistor 254 periodically detects the surface temperature of the fixing roller 250. When the detection result of the thermistor 254 has reached a certain set temperature (high set temperature), the heating control section 255 turns OFF the thermal heater 252. Moreover, when the temperature of the fixing roller 250 has decreased to a certain set temperature (low set temperature), the heating control section 255 turns ON the thermal heater 250. In this way, the heating control section 255 controls the surface temperature of the fixing roller 250 (heating control).

The heating control section 255 counts a time of the heating control, and periodically monitors whether the heating control is carried out for a set time (first set time) (S103). When the set time has not elapsed as the time of the heating control, the heating control section 255 keeps carrying out the heating control (S104).

Meanwhile, when the heating control section 255 judges by the monitoring in S102 that the set time has elapsed, it judges whether or not the surface temperature of the fixing roller 250 has reached the set temperature even just once (S105). When the surface temperature of the fixing roller 250 has not reached the set temperature, the heating control section 255 keeps carrying out the heating control (S106). Meanwhile, when the surface temperature of the fixing roller 250 has reached the set temperature, the heating control section 255 stops the heating control regardless of whether the heater driving circuit 253 is ON or OFF (S107). Moreover, in S107, in addition to the stopping of the heating control, the thermistor 254 detects the surface temperature of the fixing roller 250.

Then, the heating control section 255 monitors a time elapsed after the heating control is stopped, so as to judge whether or not a certain time has elapsed (S108). When the heating control section 255 has judged in S108 that a certain time has elapsed, the thermistor 254 detects the surface temperature of the fixing roller 250 (S109).

Then, the heating control section 255 compares a temperature Ta detected in S107 with a temperature Tb detected in S109, so as to judge whether or not (Ta-Tb) is larger than a set value (S110). When the heating control section 255 has judged in S110 that (Ta-Tb) is equal to or smaller than the set value, it terminates the warm-up (S111). Meanwhile, when the heating control section 255 has judged in S110 that (Ta-Tb) is larger than the set value, it restarts the heating control (S112).

Even after the heating control is restarted, the heating control section 255 is still counting the time of the heating control, and periodically monitoring whether or not the heating control is carried out for a set time (second set time) (S1113).

When the set time has not elapsed as the time of the heating control, the heating control section 255 keeps carrying out the heating control (S114). Meanwhile, when the heating control section 255 judges by the monitoring in S110 that the set time has elapsed, it stops the heating control regardless of whether the heater driving circuit 253 is ON or OFF (S115). Then, the warm-up is terminated (S116).

Figure 4:
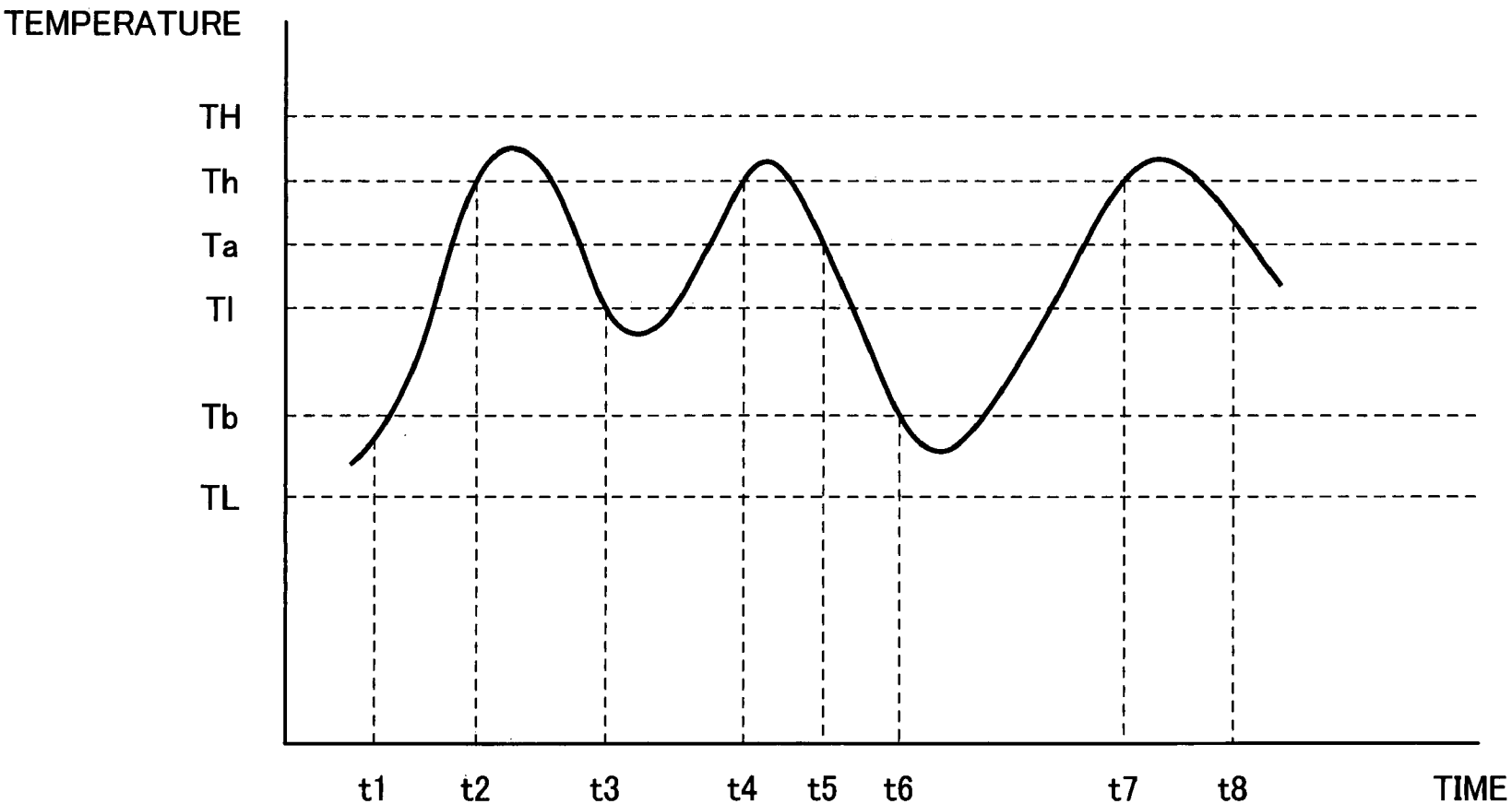
FIG. 4 shows the embodiment of the present invention, and is a graph showing the heating control (temperature control) of the fixing device.

Here, referring to FIG. 4, the following will explain a relation between (i) changes in the surface temperature of the fixing roller 250 at the time of the warm-up and (ii) timings of the heating control.

The digital color copier 1 of the present embodiment is set in advance so that the surface temperature of the fixing roller 250 is in a range from TL to TH. Moreover, Tl is such a temperature that the thermal heater 252 starts driving, and Th is such a temperature that the thermal heater 252 stops driving. Thus, each of these temperatures set in advance is different from the temperature of the drive start of the thermal heater 252 or the temperature of the drive stop of the thermal heater 252.

This is because there is a certain distance between a heated portion of the fixing roller 250 and a portion, whose surface temperature is detected, of the fixing roller 250. That is, even if the heating control section 255 stops driving the thermal heater 252 when the thermistor 254 has detected the drive stop temperature Th, the temperature of the portion whose temperature is detected by the thermistor 254 does not decrease immediately. Moreover, even if the heating control section 255 starts driving the thermal heater 252 when the thermistor 254 has detected the drive start temperature Tl, the portion whose temperature is detected by the thermistor 254 does not increase immediately.

On this account, TH is set to be higher than Th by a certain temperature, and TL is set to be lower than Tl by a certain temperature. TH may be such a temperature that fixing can be carried out securely, and TL is preferably such a temperature that it is possible to shorten a time for heating up to the printable temperature, and also possible to reduce power consumption. These TH and TL may be set accordingly in view of the fixation performance, etc. Moreover, Th and Tl may be set accordingly in view of the distance between the thermal heater 252 and the thermistor 254, the type of the thermal heater 252, etc.

As shown in FIG. 4, at the same time the warm-up is started (t1), the surface temperature of the fixing roller 250 rises. When the surface temperature of the fixing roller 250 has reached Th (t2), the thermal heater 252 stops driving. Then, the surface temperature of the fixing roller 250 decreases. When the surface temperature of the fixing roller 250 has reached Tl (t3), the thermal heater 252 starts driving. Further, when the surface temperature of the fixing roller 250 reaches Th again (t4), the thermal heater 252 stops driving. Thus, the heating control section 255 controls the surface temperature of the fixing roller 250 (heating control).

Needless to say, these drive starts or drive stops of the thermal heater 252 are carried out when the surface temperature of the fixing roller 250 has reached each set temperature, and the number of times that the thermal heater 252 starts driving or stops driving is not limited.

Then, when a time elapsed from t1 becomes a predetermined time (t5), the heating control section 255 stops the heating control (temperature control) of the fixing roller 250. In the following description, a time from t1 to t5 is referred to as "the first set time". Moreover, at t5, in addition to the stopping of the heating control of the fixing roller 250, the thermistor 254 detects the surface temperature Ta of the fixing roller 250.

After a certain time has elapsed since the heating control of the fixing roller 250 is stopped (t6), the thermistor 254 detects the surface temperature Tb of the fixing roller 250. The heating control section 255 compares Ta with Tb so as to judge whether or not (Ta-Tb) (decreased value) is larger than a predetermined value (set value). If an internal temperature of the digital color copier 1 is low, the surface temperature of the fixing roller 250 decreases within a short time from the stopping of the heating control of the fixing roller 250. As the surface temperature of the fixing roller 250 decreases, the decreased value becomes larger.

Therefore, when the decreased value is larger than the set value, the heating control section 255 carries out the heating control again. That is, the thermal heater 252 starts driving, so that the fixing roller 250 is heated. The heating control section 255 controls the surface temperature of the fixing roller 250 in a similar manner as the heating control carried out within the first set time. That is, (i) when the surface temperature of the fixing roller 250 has reached Th (t7), the thermal heater 252 stops driving, (ii) when the surface temperature of the fixing roller 250 has reached Tl, the thermal heater 252 starts driving, and (iii) when a time elapsed since the heating control is restarted (t6) becomes a predetermined time (t8), the heating control is stopped. In the following description, a time from t6 to t8 is referred to as the second set time.

Thus, the warm-up is terminated. When the decreased value is equal to or smaller than the set value, the heating control in the second set time is not carried out, and the warm-up is terminated.

Figure 5:
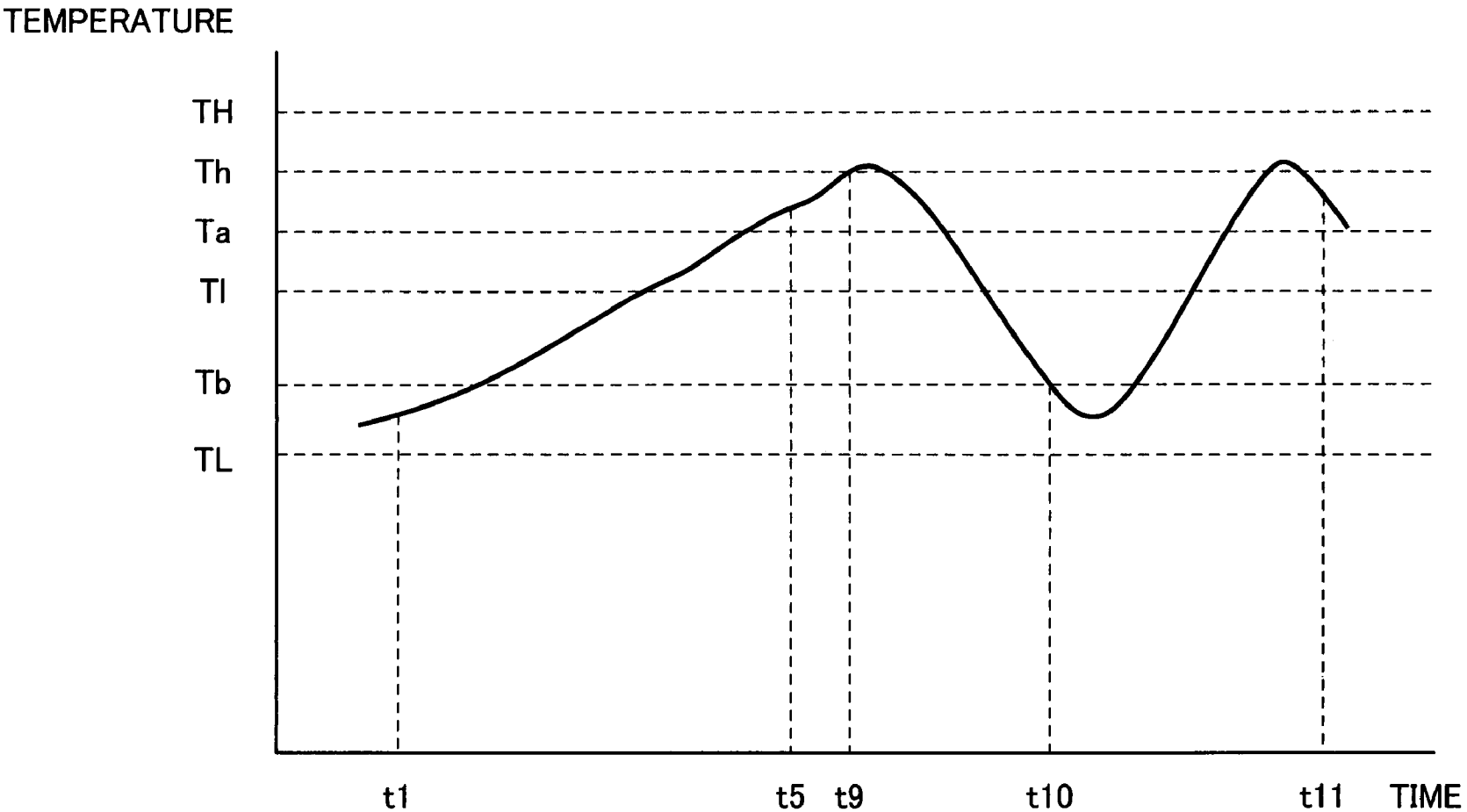
FIG. 5 shows the embodiment of the present invention, and is a graph showing the heating control (temperature control) of the fixing device.

As shown in FIG. 5, when the surface temperature of the fixing roller 250 does not reach Th within the first set time, the thermal heater 252 keeps driving even after the first set time. When the surface temperature of the fixing roller 250 has reached Th (t9), the heating control of the fixing roller 250 is stopped.

Again, the surface temperature of the fixing roller 250 is detected at t9, and the surface temperature of the fixing roller 250 is detected after a certain time elapsed from t9. Then, as with the above case, the heating control section 255 compares the difference between these temperatures with the set value, so as to judge whether to carry out the heating control again or to terminate the warm-up. In the case of carrying out the heating control again, the heating control is carried out for the same time as the second set time (from t10 to t11), and the warm-up is terminated.

Note that the temperature Th is set to be higher than the printable temperature. With this setting, even if the surface temperature of the fixing roller 250 has decreased after the warm-up but is higher than the printable temperature, it is possible to shorten a time from when a command for starting printing is inputted until when the printing is actually started.

Moreover, when the surface temperature of the fixing roller 250 has decreased after the warm-up and is lower than the printable temperature, it is necessary to carry out the heating control again. However, since the fixing roller 250 is heated in advance so as to have the temperature Th that is higher than the printable temperature, it is possible to shorten the time from when a command for starting printing is inputted until when the fixing roller 250 is heated up to the printable temperature.

Moreover, in the digital color copier 1 which drives in the energy saving mode, when the cleaning of the photosensitive drums 222*a* to 222*d* are terminated, the heating of the fixing roller 250 usually stops. That is, in this case, the first set time is a cleaning time for cleaning the photosensitive drums 222*a* to 222*d*.

In the digital color copier 1, the surface temperature of the fixing roller 250 may be the lowest when the main switch is turned ON first thing in the morning. Therefore, when the time of the warm-up carried out first thing in the morning is equal to the cleaning time of the photosensitive drums 222*a* to 222*d*, the fixing roller 250 is not heated sufficiently. On this account, when carrying out the printing first thing in the morning, it is necessary to heat the fixing roller 250. Therefore, in order to carry out the printing first thing in the morning, a long time is necessary for starting the printing.

In the present invention, when the surface temperature of the fixing roller 250 has decreased drastically, the fixing roller 250 is further heated after it is heated during the cleaning time of the photosensitive drums 222*a* to 222*d*. On this account, even when carrying out the printing first thing in the morning, it is possible to shorten a time from when a command for starting printing is inputted until when the printing is started.

The above-described control can be carried out while varying the second set time. That is, the second set time may be set accordingly in accordance with the surface temperature of the fixing roller 250. The second set time may be set accordingly in accordance with, for example, the type of the thermal heater 252, and is preferably in a range from usually 1 second to 1 minute.

Moreover, a user may directly input the second set time. In this case, the digital color copier 1 has an input section and a display section, and the user may set the second set time using the input section.

Moreover, the second set time may be set in accordance with (i) an ambient temperature of a place where the digital color copier 1 is installed and/or (ii) a season, or may be set in accordance with the surface temperature of the fixing roller 250 when the main switch is turned ON. In this case, as with the above case, the user can input the second set time directly, but it is also possible to automatically set the appropriate control time in accordance with the ambient temperature, the season, the surface temperature, etc. detected by the heating control section 255. In this case, since the control time is automatically set at the same time the main switch is turned ON, the user's operation is not necessary.

Therefore, since the heating control time can be set according to need by controlling the warm-up in the above manner, it is possible to carry out the control with a minimum amount of power consumption. Moreover, since the heating control is further carried out when the surface temperature of the fixing roller 250 has decreased drastically, it is possible to shorten a time from when a command for starting printing is inputted until when the printing is started.

Then, after the fixing roller 250 becomes a printable state, the image formation is carried out in the following manner. First, the image data is inputted to the digital color copier 1, the laser beam scanner unit (227*a*, 227*b*, 227*c*, 227*d*) exposes the surface of the photosensitive drum (222*a*, 222*b*, 222*c*, 222*d*) in accordance with the input image data, and an electrostatic latent image is formed on each of the photosensitive drums 222*a* to 222*d*.

The electrostatic latent images are developed by the development devices 224*a* to 224*d*, so that toner images are obtained. Meanwhile, the sheets P in the sheet tray 233 are separated one-by-one by the paper feeding roller 234, conveyed to the sheet conveyance path, and held once by the resist roller 212. The resist roller 212 controls a timing of conveyance on the basis of a detection signal of a pre-resist detection switch (not shown) so that the tip portion of the toner image on each of the photosensitive drums 222*a* to 222*d* meets the tip portion of an image forming region of the sheet P. Then, the resist roller 212 conveys the sheet P to the transferring/conveying belt 216 in time with the rotation of the photosensitive drums 222*a* to 222*d*. The sheet P is conveyed while electrostatically attracted onto the transferring/conveying belt 216.

The transfer of the toner images from the photosensitive drums 222*a* to 222*d* to the sheet P is carried out by the transfer roller 225*a* to 225*d* which respectively face the photosensitive drums 222*a* to 222*d* via the transferring/conveying belt 216. A high voltage having a polarity opposite that of the toner is applied to the transfer rollers 225*a* to 225*d*. With this voltage, the toner images are formed on the sheet P. Four toner images corresponding to respective colors sequentially overlaps each other on the sheet P conveyed by the transferring/conveying belt 216.

Then, the sheet P is conveyed to the fixing section 217. The sheet P passes through the nip portion between the fixing roller 250 and the pressure roller 251. Here, the toner image is fixed on the sheet P by the heat and pressure of the fixing roller 250 and the pressure roller 251. The sheet P on which the toner image is fixed is removed from the fixing roller 250, and is conveyed to the conveyance direction switching gate 218. Then, the conveyance direction switching gate 218 switches the conveyance path, so that the sheet P is conveyed to the paper output tray 220 or to the image forming section 210.

After the transfer to the sheet P, the cleaning devices 226*a* to 226*d* collect/remove the toner remaining on the photosensitive drums 222*a* to 222*d*. Moreover, the toner adhered to the transferring/conveying belt 216 is collected/removed. Thus, a series of image forming operations are terminated.

The foregoing description explained the digital color copier 1 which drives in the energy saving mode, however, the present invention is applicable to a digital color copier which drives in such a mode (non-energy saving mode) that the temperature control of the fixing roller is carried out even in a standby state (such a state that the warm-up or the printing is not carried out).

That is, when the digital color copier which drives in the non-energy saving mode is not operating for a certain time, the surface temperature of the fixing roller keeps on decreasing. Then, when the surface temperature of the fixing roller has decreased to a certain temperature, the warm-up is started. This warm-up is carried out in the same way as the warm-up in the digital color copier 1.

Here, the warm-up is started when the surface temperature of the fixing roller has decreased to a certain temperature. However, the warm-up may be started when a difference between (i) the surface temperature of the fixing roller after a certain time has elapsed from the termination of the warm-up (ii) the surface temperature of the fixing roller when the warm-up is terminated is equal to or larger than a certain value.

In this case, the surface temperature of the fixing roller is periodically monitored, and the surface temperature of the fixing roller is controlled so as to be a desired temperature. On this account, it is possible to shorten a time from when a command for starting printing is inputted until when the printing is started.

EMBODIMENT 2

Figure 6:
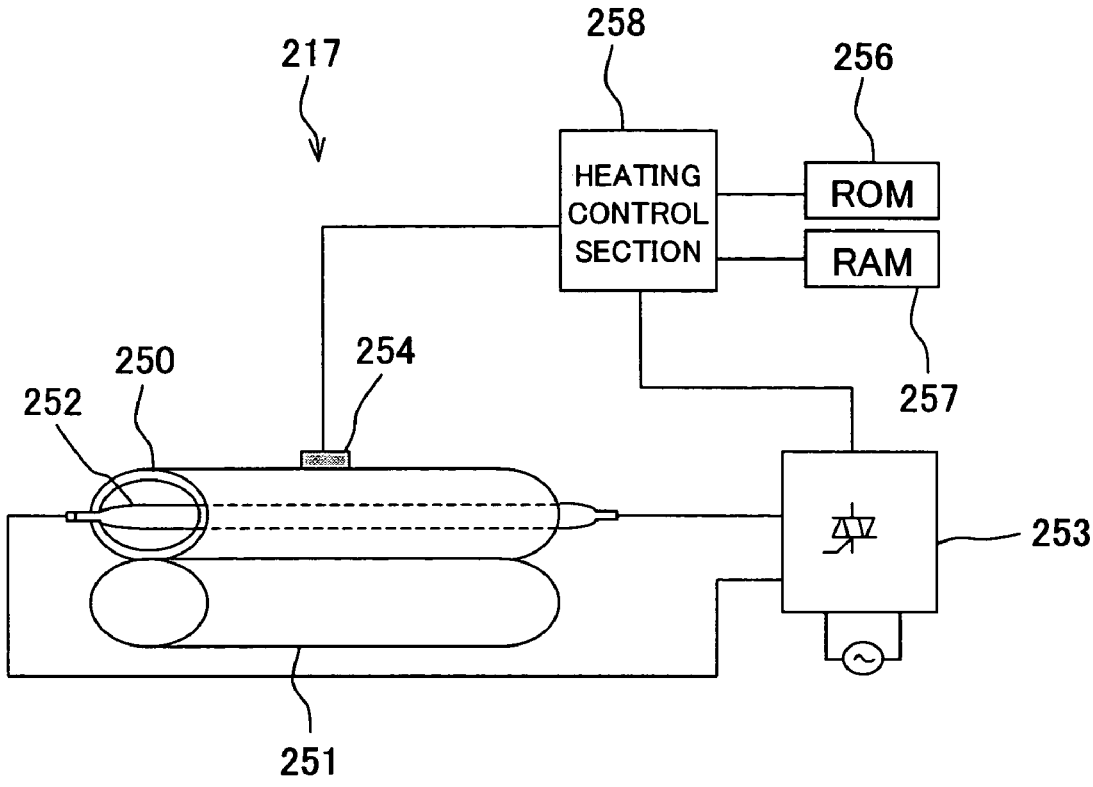
FIG. 6 shows another embodiment of the present invention, and is a schematic diagram showing a schematic configuration of a fixing device.
Figure 7:
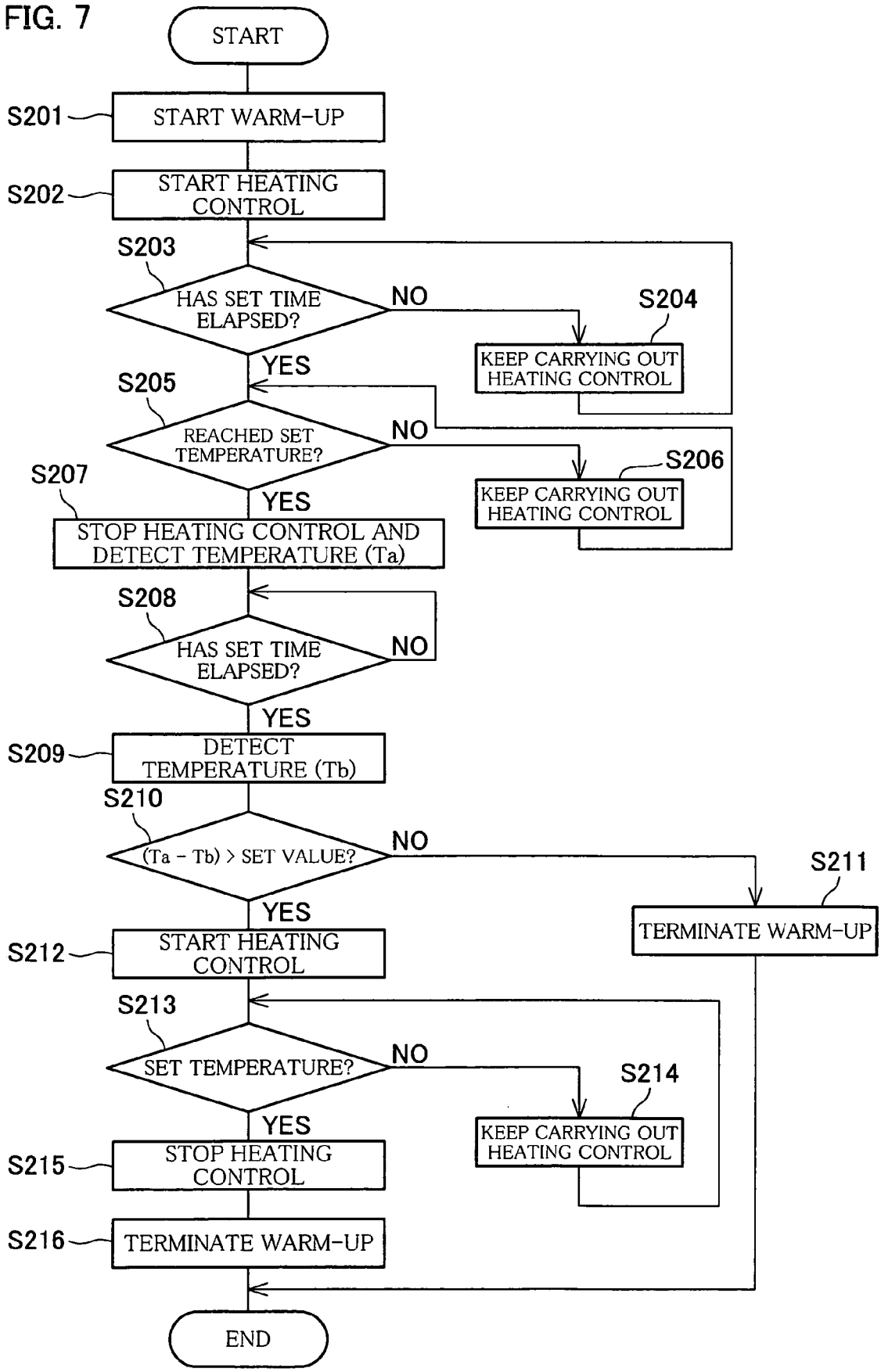
FIG. 7 shows the embodiment of the present invention, and is a flow chart showing heating control (temperature control) of the fixing device.
Figure 8:
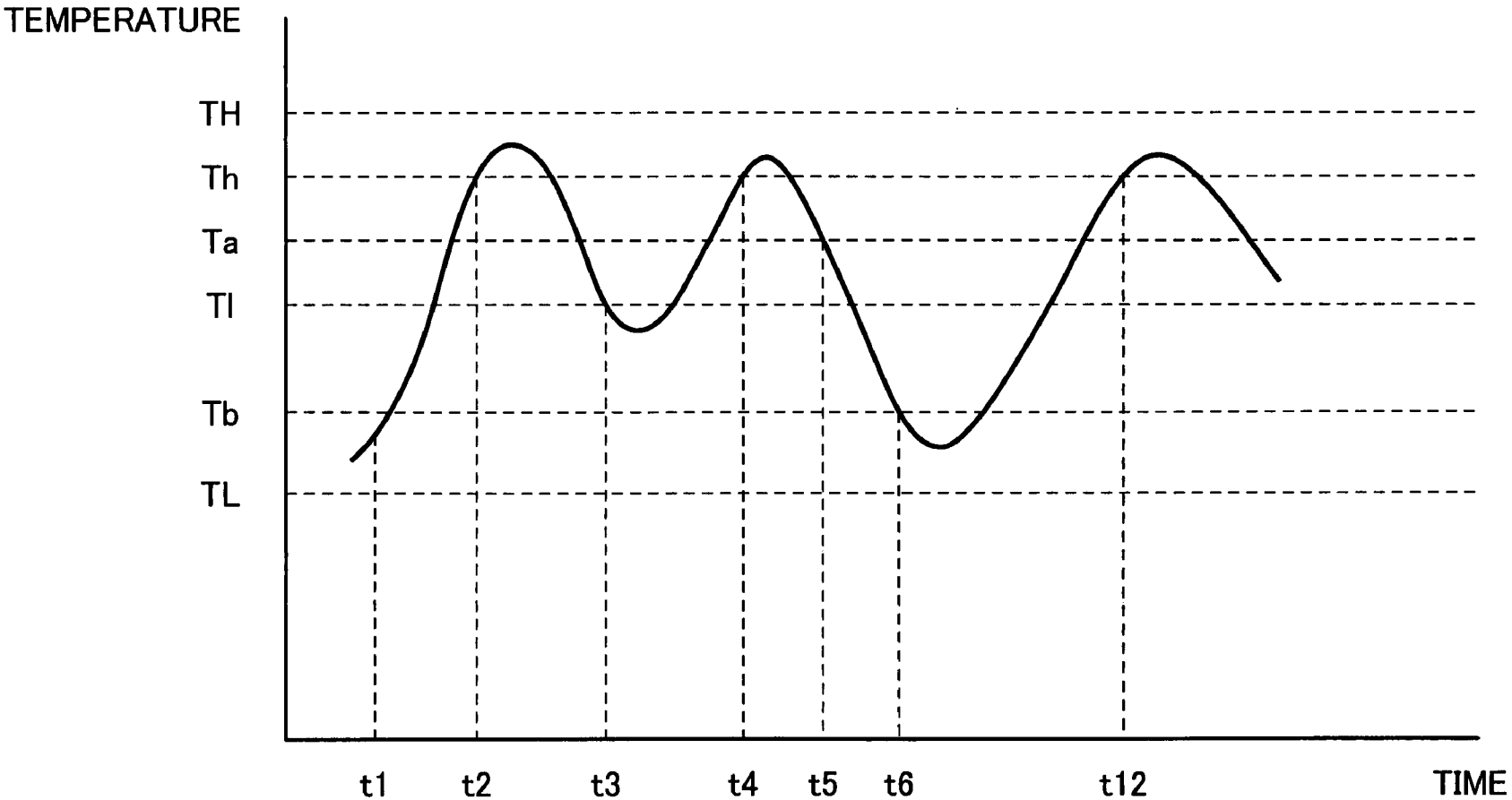
FIG. 8 shows the embodiment of the present invention, and is a graph showing the heating control (temperature control) of the fixing device.
Figure 9:
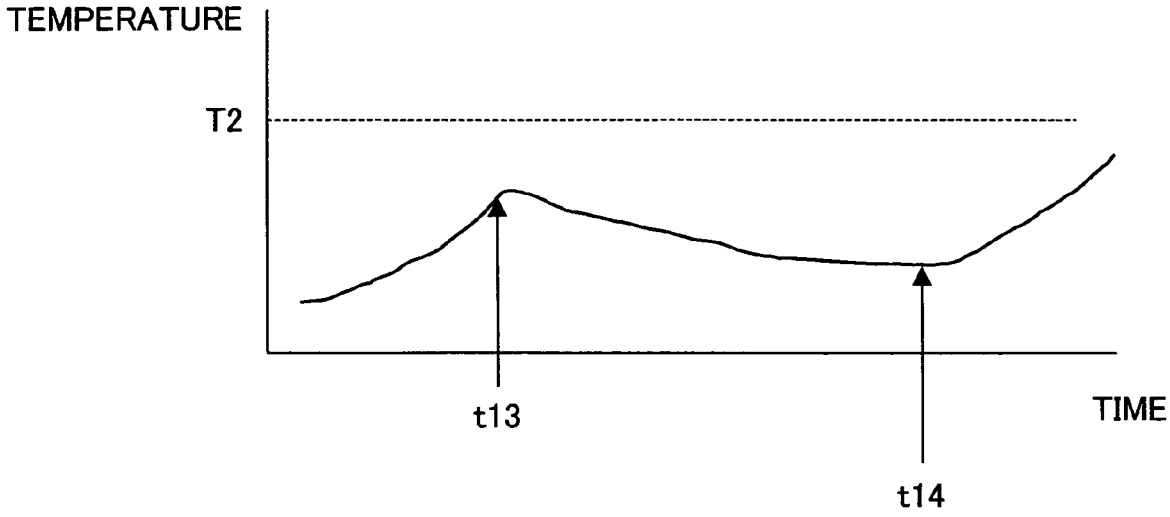
FIG. 9 is a graph showing the temperature control of a conventional fixing device.

The following will explain Embodiment 2 of the present invention in reference to FIGS. 6 to 8. The present embodiment is the same as Embodiment 1 except for a method of the heating control at the time of the warm-up. On this account, the same reference numerals are used for the members having the same functions as the members explained in Embodiment 1, and further explanations thereof are omitted. Moreover, the present embodiment will mainly explain the heating control (temperature control) of the fixing section 217, which is different from Embodiment 1.

FIG. 6 is a schematic diagram showing a schematic configuration of the fixing section 217 of the present embodiment. The fixing section 217 shown in FIG. 6 includes the fixing roller 250, the pressure roller 251, the thermal heater 252, the heater driving circuit 253, the thermistor 254, a heating control section (heating control means) 258, the ROM 256, and the RAM 257.

The heating control section 258 of the present embodiment controls the temperature of the fixing section 217. The heating control of the fixing section 217 is carried out by controlling the surface temperature of the fixing roller 250. The heating control section 258 outputs to the heater driving circuit 253 the trigger signal for turning ON or OFF a heater. Moreover, the heating control section 258 causes the A/D converter to convert the temperature detection signal, output from the thermistor 254, to the digital signal, and outputs it to the ROM 256. For example, a CPU (Central Processing Unit) can be used as the heating control section 258.

The heating control section 258 carries out the heating control of the fixing section 217 on the basis of the control data and the program(s) stored in the ROM 256 or the RAM 257. That is, the heating control section 258 controls the surface temperature of the fixing roller 250 on the basis of the program(s) stored in the ROM 256. This control is carried out by reading, according to need, the control data stored in the RAM 257. Specifically, the thermistor 254 detects the surface temperature of the fixing roller 250, and then the heating control section 258 controls ON or OFF (drive start or drive stop) of the thermal heater 252 on the basis of this detection result.

The heating control section 258 may be provided separately from the control section which controls a series of operations of the digital color copier 1, or may be provided in the control section. When the heating control section 258 is provided in the control section, as with Embodiment 1, the control section carries out various controls, such as the printing operation, the warm-up, and the control of the surface temperature of the fixing roller 250, on the basis of the program(s) stored in the ROM 256. These controls are carried out by reading, according to need, the control data stored in the RAM 257.

Next, the following will explain a series of operations of the digital color copier 1 of the present embodiment.

As with Embodiment 1, the digital color copier 1 of the present embodiment carries out the warm-up when the main switch is turned ON or when the replacement cover opens/closes. Moreover, the digital color copier 1 drives in the energy saving mode. Referring to FIG. 7, the following will explain the warm-up carried out when the main switch is turned ON in the present embodiment.

As shown in FIG. 7, when the main switch of the digital color copier 1 is turned ON, the heating control section 258 (or the control section (the heating control section 258 may be replaced with the control section in the following description)) instructs to start the warm-up (S201). That is, the heating control section 258 starts the heating control (S202). Thus, the heater driving circuit 253 is turned ON, and the thermal heater 252 starts heating the fixing roller 250. The surface temperature of the fixing roller 250 rises by heating of the thermal heater 252.

Moreover, the thermistor 254 periodically detects the surface temperature of the fixing roller 250. When the detection result of the thermistor 254 has reached a certain set temperature (high set temperature), the heating control section 258 turns OFF the thermal heater 252. Moreover, when the temperature of the fixing roller 250 has decreased to a certain set temperature (low set temperature), the heating control section 258 turns ON the thermal heater 250. In this way, the heating control section 258 controls the surface temperature of the fixing roller 250 (heating control).

The heating control section 258 counts a time of the heating control, and periodically monitors whether the heating control is carried out for a set time (first set time) (S203). When the set time has not elapsed as the time of the heating control, the heating control section 258 keeps carrying out the heating control (S204).

Meanwhile, when the heating control section 258 judges by the monitoring in S202 that the set time has elapsed, it judges whether or not the surface temperature of the fixing roller 250 has reached the set temperature even just once (S205). When the surface temperature of the fixing roller 250 has not reached the set temperature, the heating control section 258 keeps carrying out the heating control (S206). Meanwhile, when the surface temperature of the fixing roller 250 has reached the set temperature, the heating control section 258 stops the heating control regardless of whether the heater driving circuit 253 is ON or OFF (S207). Moreover, in S207, in addition to the stopping of the heating control, the thermistor 254 detects the surface temperature of the fixing roller 250.

Then, the heating control section 258 monitors a time elapsed after the heating control is stopped, so as to judge whether or not a certain time has elapsed (S208). When the heating control section 258 has judged in S208 that a certain time has elapsed, the thermistor 254 detects the surface temperature of the fixing roller 250 (S209).

Then, the heating control section 258 compares a temperature Ta detected in S207 with a temperature Tb detected in S209, so as to judge whether or not (Ta-Tb) is larger than a set value (S210). When the heating control section 258 has judged in S210 that (Ta-Tb) is equal to or smaller than the set value, it terminates the warm-up (S211). Meanwhile, when the heating control section 258 has judged in S210 that (Ta-Tb) is larger than the set value, it restarts the heating control (S212).

Even after the heating control is restarted, the heating control section 258 periodically monitors, on the basis of the detection result of the thermistor 254, whether or not the surface temperature of the fixing roller 250 has reached the set temperature (S213).

When the surface temperature of the fixing roller 250 has not reached the set temperature, the heating control section 258 keeps carrying out the heating control (S214). Meanwhile, when the heating control section 258 judges by the monitoring in S213 that the surface temperature of the fixing roller 250 has reached the set temperature, the heater driving circuit 253 is turned OFF, and the heating control section 258 stops the heating control (S215). Then, the warm-up is terminated (S216).

Here, referring to FIG. 8, the following will explain a relation between (i) changes in the surface temperature of the fixing roller 250 at the time of the warm-up and (ii) timings of the heating control.

As with Embodiment 1, the digital color copier 1 of the present embodiment is set in advance so that the surface temperature of the fixing roller 250 is in a range from TL to TH. Moreover, Tl is such a temperature that the thermal heater 252 starts driving, and Th is such a temperature that the thermal heater 252 stops driving.

As shown in FIG. 8, at the same time the warm-up is started (t1), the surface temperature of the fixing roller 250 rises. When the surface temperature of the fixing roller 250 has reached Th (t2), the thermal heater 252 stops driving. When the surface temperature of the fixing roller 250 has reached Tl (t3), the thermal heater 252 starts driving. Further, when the surface temperature of the fixing roller 250 reaches Th again (t4), the thermal heater 252 stops driving. Thus, the heating control section 258 controls the surface temperature of the fixing roller 250 (heating control). In the present embodiment, the number of times that the thermal heater 252 starts driving or stops driving is not limited.

Then, after the first set time (t5), the heating control section 258 stops the heating control of the fixing roller 250. Moreover, at t5, in addition to the stopping of the heating control of the fixing roller 250, the thermistor 254 detects the surface temperature Ta of the fixing roller 250.

After a certain time has elapsed since the heating control of the fixing roller 250 is stopped (t6), the thermistor 254 detects the surface temperature Tb of the fixing roller 250. The heating control section 258 compares Ta with Tb so as to judge whether or not (Ta-Tb) (decreased value) is larger than a predetermined value (set value).

When the decreased value is larger than the set value, the heating control section 258 carries out the heating control again. This restarted heating control is carried out while detecting the surface temperature of the fixing roller 250. When the surface temperature of the fixing roller 250 reaches Th (t12), the heating control section 258 stops the heating control of the fixing roller 250.

Thus, the warm-up is terminated. When the decreased value is equal to or smaller than the set value, the heating control in the second set time is not carried out, and the warm-up is terminated.

In the present embodiment, as with Embodiment 1, when the surface temperature of the fixing roller 250 does not reach Th within the first set time, the thermal heater 252 keeps driving even after the first set time. When the surface temperature of the fixing roller 250 has reached Th, the heating control of the fixing roller 250 is stopped. Then, the heating control section 258 judges whether to carry out the heating control again or to terminate the warm-up. In the case of carrying out the heating control again, the heating control is stopped when the surface temperature of the fixing roller 250 has reached Th, and the warm-up is terminated.

Note that the temperature Th is set to be higher than the printable temperature. As with Embodiment 1, even if the surface temperature of the fixing roller 250 has decreased after the warm-up but is higher than the printable temperature, it is possible to shorten a time from when a command for starting printing is inputted until when the printing is actually started. Moreover, when the surface temperature of the fixing roller 250 is lower than the printable temperature, it is necessary to carry out the heating control again. However, it is possible to shorten the time from when a command for starting printing is inputted until when the fixing roller 250 is heated up to the printable temperature. Moreover, as with Embodiment 1, even when carrying out the printing first thing in the morning, it is possible to shorten a time from when a command for starting printing is inputted until when the printing is started.

Therefore, by controlling the warm-up in the above manner, it is possible to carry out the heating control of the fixing roller 250 with a minimum amount of power consumption. Moreover, since the heating control is further carried out when the surface temperature of the fixing roller 250 has decreased drastically, it is possible to shorten a time from when a command for starting printing is inputted until when the printing is started.

Then, after the fixing roller 250 becomes a printable state, the image formation is carried out in the same manner as Embodiment 1.

The foregoing description explained the digital color copier 1 which drives in the energy saving mode, however, the present embodiment is applicable to a digital color copier which drives in the non-energy saving mode, as with Embodiment 1. In this case, the surface temperature of the fixing roller is periodically monitored, and the surface temperature of the fixing roller is controlled so as to be a desired temperature. On this account, it is possible to shorten a time from when a command for starting printing is inputted until when the printing is started.

As described above, the fixing device of the present invention includes: a first roller and a second roller which are provided so as to contact each other; heating means for heating the first roller; temperature detecting means for detecting a temperature of the first roller; and heating control means for controlling a drive start or drive stop of the heating means based on the temperature detected by the temperature detecting means, the fixing device fixing a developer image formed on a recording material conveyed to between the first roller and the second roller, the heating control means carrying out control of the heating means for a predetermined time, and restarting the control of the heating means based on a difference between the temperature of the first roller when the control of the heating means is stopped and the temperature of the first roller after a certain time has elapsed since the control of the heating means is stopped.

Moreover, in the fixing device of the present invention, it is preferable that the heating control means carry out the restarted control of the heating means for a certain time. According to the above-described configuration, since the restarted control of the heating means is carried out for a certain time, the heating control means can control the heating means so that the temperature of the first roller becomes a desired temperature. Thus, it is possible to shorten a time for heating the first roller to carry out the fixing, and also possible to reduce the amount of power consumption.

In the fixing device of the present invention, it is preferable that the heating control means carry out the restarted control of the heating means for a time corresponding to the difference. According to the above-described configuration, the restarted control of the heating means is carried out for a time corresponding to the difference. That is, a control time for controlling the heating means can be changed in accordance with the difference. Thus, it is possible to carry out the temperature control of the first roller highly efficiently and highly precisely.

For example, if it is possible to predict a trend of temperature rising of the first roller by heating of the heating means, the control time may be set based on this trend. In this case, since the control time is set based on this trend, it is possible to carry out the temperature control of the first roller more easily.

In the fixing device of the present invention, it is preferable that the heating control means stop the restarted control of the heating means after a time, set based on (i) the temperature of the first roller when the heating means starts driving, and/or (ii) a season, has elapsed. According to the above-described configuration, the restarted control of the heating means is stopped after the above time has elapsed. This time is set based on (i) the temperature of the first roller when the heating means starts driving, and/or (ii) a season.

Thus, by considering the temperature of the first roller when the heating means starts driving, it is possible to set a control time necessary for causing the temperature of the first roller to reach a desired temperature. By causing the restart control of the heating means to be stopped after this control time has elapsed, it is possible to carry out the temperature control more highly precisely. Moreover, an ambient temperature of the fixing device changes depending on a season. Therefore, by setting the control time by considering a season, it is possible to carry out the temperature control of the first roller further highly precisely.

Further, since the control time is set based on the temperature of the first roller and/or a season, it is possible to set the appropriate control time automatically. On this account, for example, it is not necessary to set the time each time a user uses, and it is possible to easily carry out the temperature control.

In the fixing device of the present invention, it is preferable that the heating control means stop the restarted control of the heating means after a time set by a user has elapsed. According to the above-described configuration, the heating control means stops the restarted control of the heating means after a time set in advance by a user has elapsed. Thus, by setting the control time of the heating means by a user, it is possible to change the length of the control time according to need. Therefore, it is possible to carry out the temperature control of the first roller more highly precisely.

In the fixing device of the present invention, it is preferable that the heating control means stop the restarted control of the heating means after the temperature of the first roller has reached a predetermined temperature. According to the above-described configuration, the restarted control of the heating means is stopped when the temperature of the first roller becomes a predetermined temperature. That is, since it is possible to stop the control of the heating means when the temperature of the first roller has become a desired temperature, it is possible to carry out the temperature control of the first roller highly efficiently and highly precisely.

Note that an image forming apparatus of the present invention includes any one of the above-described fixing devices. Moreover, the image forming apparatus of the present invention may carry out the control of the heating means only at a startup of the image forming apparatus. When the image forming apparatus is started up after it has not operated for a long time, the temperature of the first roller may be completely low. For example, especially when the image forming apparatus is started up first thing in the morning, the temperature of the first roller is especially low. In this case, in order to carry out the printing, it is necessary to heat the first roller so that the temperature of the first roller is such a temperature that the printing can be carried out. However, according to the above-described configuration, the heating means is controlled at the startup of the image forming apparatus. Therefore, even when the printing is requested just after the startup, it is possible to shorten the time from when a command for starting printing is inputted until when the printing is started.

As described above, in the fixing device of the present invention, the heating control means carries out the control of the heating means for a predetermined time, and restarts the control of the heating means based on a difference between (i) the temperature of the first roller when the control of the heating means is stopped and (ii) the temperature of the first roller after a certain time has elapsed since the control of the heating means is stopped. Therefore, it is possible to shorten a time for heating the first roller, and also possible to reduce the amount of power consumption.

Moreover, as described above, the image forming apparatus of the present invention includes the fixing device. Therefore, it is possible to shorten a time from when a command for starting printing is inputted until when the printing is actually started.

The present invention may also be described as a fixing device of an image forming apparatus, the fixing device including (i) a fixing roller which is heated by heating means, and whose surface temperature is controlled so as to be a set temperature set in advance, (ii) a pressure roller which contacts the fixing roller, and (iii) surface temperature detecting means for detecting the surface temperature of the fixing roller, the fixing roller and the pressure roller sandwiching and conveying a transfer material having an unfixed toner image, and the unfixed toner image being fixed on the transfer material, and only the warm-up carried out after a main switch is tuned ON being carried out for a warm-up time set by a user.

Further, the warm-up time (compensation time) of the fixing device may be set automatically depending on the temperature and/or the season when the main switch is turned ON.

Moreover, the present invention may also be described as a fixing device of an image forming apparatus, the fixing device including (i) a fixing roller which is heated by heating means, and whose surface temperature is controlled so as to be a set temperature set in advance, (ii) a pressure roller which contacts the fixing roller, and (iii) surface temperature detecting means for detecting the surface temperature of the fixing roller, the fixing roller and the pressure roller sandwiching and conveying a transfer material having an unfixed toner image, and the unfixed toner image being fixed on the transfer material, and only the warm-up carried out when a main switch is turned ON being carried out until when the surface temperature of the fixing roller becomes a predetermined temperature.

The present invention is not limited to the embodiments above, but may be altered within the scope of the claims. An embodiment based upon a proper combination of technical means disclosed in different embodiments is encompassed in the technical scope of the present invention.

INDUSTRIAL APPLICABILITY

As described above, by using the fixing device of the present invention, it is possible to shorten the wait time from when a command for starting printing is inputted until when the printing is started, and also possible to reduce the amount of power consumption. Therefore, the fixing device of the present invention is suitably used in various apparatuses for forming images. On this account, the present invention can be suitably used in an industrial field related to the fixing device or the image forming apparatus, and an industrial field for manufacturing various electronics devices, electric devices, and their parts.

The invention claimed is:

1. A fixing device comprising: a first roller and a second roller which are provided so as to contact each other; heating means for heating the first roller; temperature detecting means for detecting a temperature of the first roller; and heating control means for controlling a drive start or drive stop of said heating means based on the temperature detected by said temperature detecting means, the fixing device fixing a developer image formed on a recording material conveyed to between the first roller and the second roller, said heating control means carrying out control of said heating means for a predetermined time, and restarting the control of said heating means based on a difference between the temperature of the first roller when the control of said heating means is stopped and the temperature of the first roller after a certain time has elapsed since the control of said heating means is stopped.

2. The fixing device as set forth in claim 1, wherein said heating control means carries out the restarted control of said heating means for a certain time.

3. The fixing device as set forth in claim 1, wherein said heating control means carries out the restarted control of said heating means for a time corresponding to the difference.

4. The fixing device as set forth in claim 1, wherein said heating control means stops the restarted control of said heating means after a time, set based on (i) the temperature of the first roller when said heating means starts driving, and/or (ii) a season, has elapsed.

5. The fixing device as set forth in claim 1, wherein said heating control means stops the restarted control of said heating means after a time set by a user has elapsed.

6. The fixing device as set forth in claim 1, wherein said heating control means stops the restarted control of said heating means after the temperature of the first roller has reached a predetermined temperature.

7. An image forming apparatus comprising a fixing device including: a first roller and a second roller which are provided so as to contact each other; heating means for heating the first roller; temperature detecting means for detecting a temperature of the first roller; and heating control means for controlling a drive start or drive stop of said heating means based on the temperature detected by said temperature detecting means, the fixing device fixing a developer image formed on a recording material conveyed to between the first roller and the second roller, said heating control means carrying out control of said heating means for a predetermined time, and restarting the control of said heating means based on a difference between the temperature of the first roller when the control of said heating means is stopped and the temperature of the first roller after a certain time has elapsed since the control of said heating means is stopped.

8. The image forming apparatus as set forth in claim 7, wherein the control of said heating means is carried out only at a startup of the image forming apparatus.

* * * * *